US010925361B2

(12) United States Patent
Ma

(10) Patent No.: US 10,925,361 B2
(45) Date of Patent: Feb. 23, 2021

(54) COLLAPSIBLE UMBRELLA ASSEMBLY HAVING A CANOPY SUPPORTED USING STABILIZING STRUTS

(71) Applicant: Mark J. S. Ma, Jurupa Valley, CA (US)

(72) Inventor: Mark J. S. Ma, Jurupa Valley, CA (US)

( * ) Notice: Subject to any disclaimer, the term of this patent is extended or adjusted under 35 U.S.C. 154(b) by 0 days.

(21) Appl. No.: 16/392,602

(22) Filed: Apr. 23, 2019

(65) Prior Publication Data

US 2019/0323258 A1 Oct. 24, 2019

Related U.S. Application Data

(60) Provisional application No. 62/661,531, filed on Apr. 23, 2018.

(51) Int. Cl.
*A45B 23/00* (2006.01)
*A45B 25/02* (2006.01)

(52) U.S. Cl.
CPC ..... *A45B 23/00* (2013.01); *A45B 25/02* (2013.01); *A45B 2023/005* (2013.01); *A45B 2023/0012* (2013.01); *A45B 2023/0031* (2013.01); *A45B 2023/0037* (2013.01); *A45B 2023/0068* (2013.01); *A45B 2023/0075* (2013.01)

(58) Field of Classification Search
CPC ..... A45B 17/00; A45B 25/02; A45B 25/14; A45B 25/22; A45B 25/08; A45B 9/02; A45B 2023/0031; A45B 2023/0012; A45B 2023/0037; A45B 25/165; A45B 2025/146; A45B 23/00; A45B 2023/005; A45B 2023/0068; A45B 2023/0075
USPC ..... 135/90, 98, 16, 20.1, 20.3, 21, 25.2, 29, 135/31, 27
See application file for complete search history.

(56) References Cited

U.S. PATENT DOCUMENTS 3,120,238 A * 2/1964 Glatz ..... A45B 17/00 135/21
4,638,827 A * 1/1987 DeMarco ..... A45B 19/06 135/26

(Continued)

FOREIGN PATENT DOCUMENTS

AT 520680 A1 * 6/2019 ..... A45B 23/00
DE 202015105277 U1 * 12/2015 ..... A45B 23/00

(Continued)

OTHER PUBLICATIONS

Https://tuuci.getbynder.com/m/08d6e3673aadf810/original/OMX-Single-Cantilever.pdf; Ocean Master MAX Single Cantilever Premium Parasols; Jun. 13, 2017.

(Continued)

*Primary Examiner* — Robert Canfield
(74) *Attorney, Agent, or Firm* — Liu & Liu

(57) ABSTRACT

An umbrella assembly having a post supporting first and second pivot joints to move relative to each other along the post, and a support strut and adjacent stabilizing struts pivotally coupled to the first and second pivot joints and supporting the collapsible frame assembly of a canopy. The collapsible frame assembly collapses between an opened configuration and a collapsed configuration with movement of the first and second pivot joints relative to each other.

20 Claims, 16 Drawing Sheets

(56) References Cited

U.S. PATENT DOCUMENTS

| | | | | |
|---|---|---|---|---|
| 5,960,806 | A * | 10/1999 | Steiner | A45B 23/00 135/20.1 |
| 6,196,242 | B1 * | 3/2001 | Xu | A45B 23/00 135/20.1 |
| 6,314,976 | B1 | 11/2001 | Clarke | |
| 6,386,214 | B1 | 5/2002 | Clarke | |
| 6,401,735 | B1 * | 6/2002 | Chou | A45B 23/00 135/20.1 |
| 6,478,037 | B2 * | 11/2002 | Tung | A45B 23/00 135/20.1 |
| 6,588,438 | B1 * | 7/2003 | Steiner | A45B 23/00 135/20.1 |
| 6,840,253 | B2 * | 1/2005 | Ma | A45B 17/00 135/155 |
| 6,889,699 | B2 | 5/2005 | Clarke | |
| 7,293,573 | B2 | 11/2007 | Clarke | |
| 7,318,444 | B2 | 1/2008 | Clarke | |
| 8,096,310 | B2 | 1/2012 | Clarke | |
| 8,104,492 | B2 * | 1/2012 | Dan | A45B 23/00 135/20.3 |
| 9,167,873 | B2 * | 10/2015 | May | A45B 23/00 |
| 9,220,325 | B2 * | 12/2015 | Ma | A45B 23/00 |
| 9,289,038 | B2 * | 3/2016 | Ma | A45B 25/08 |
| 9,565,907 | B2 * | 2/2017 | Ma | A45B 25/02 |
| 9,642,421 | B2 | 5/2017 | Ma | |
| 9,655,416 | B1 | 5/2017 | Clarke | |
| 10,537,161 | B1 * | 1/2020 | Volin | A45B 25/14 |
| 2003/0140955 | A1 * | 7/2003 | Chou | E04H 15/50 135/98 |
| 2004/0177871 | A1 | 9/2004 | Harbaugh | |
| 2005/0016571 | A1 * | 1/2005 | Wu | A45B 25/165 135/20.1 |

FOREIGN PATENT DOCUMENTS

| | | | | |
|---|---|---|---|---|
| DE | 202020000862 | U1 * | 4/2020 | A45B 25/00 |
| EP | 2580982 | A1 * | 4/2013 | A45B 23/00 |
| WO | WO-2018164626 | A1 * | 9/2018 | A45B 19/00 |

OTHER PUBLICATIONS

Installation Instructions for TUUCI Ocean Master Max and Plantation Max Cantilever with High Wind Stabilizers; Apr. 1, 2013; pp. 1-3.

Assembly & Operating Instructions for TUUCI Tilt Cantilever INSA2000; Jul. 25, 2017; pp. 1-8.

* cited by examiner

COLLAPSIBLE UMBRELLA ASSEMBLY HAVING A CANOPY SUPPORTED USING STABILIZING STRUTS

This application claims the priority of U.S. Provisional Patent Application No. 62/661,531 filed on Apr. 23, 2018, which is fully incorporated by reference as if fully set forth herein. All publications noted below are fully incorporated by reference as if fully set forth herein.

BACKGROUND OF THE INVENTION

1. Field of the Invention

The present invention is directed to large size umbrellas, in particular umbrellas of the type having a canopy supported by a post.

2. Description of Related Art

Heretofore, large umbrellas, such as patio umbrellas, include a shade or canopy (e.g., comprising a fabric panel supported by a rib frame structure) supported at the end of a support arm extending from a generally vertical support post.

For example, U.S. Pat. No. 6,840,253 to Ma, the inventor of the present invention, discloses a "side post umbrella" that includes a side arm supported by and cantilevered from a side support post. A canopy hangs from the extended end of the side arm.

U.S. Pat. No. 9,565,907 to Ma, the inventor of the present invention, discloses an umbrella having a canopy supported by a support arm extending from a vertical post, with the crown of the canopy coupled to the support arm via a pivot joint that is structured and configured to allow swiveling and/or tilting of the canopy with ease by a user. In one embodiment disclosed therein, the support arm is a long rib of the frame of the canopy.

It is desirable to collapse the frame of the canopy when the canopy is not used to provide shading. However, a collapsible canopy frame assembly brings challenges to structural integrity and ease of operation for a user to open and collapse the canopy. Given the span of the canopy when it is in the opened state, strong winds would impose strong forces on the canopy, thereby affecting the stability of the canopy with respect to the vertical post. Significant stresses in the support arm and the hinge between the support arm and the vertical post would lead to premature failure of the umbrella assembly. While reinforcement of frame components would improve structural integrity and stability against wind forces, however it could compromise the extent and/or ease of collapsing the canopy frame.

There is a need for a simple, reliable and easy to operate umbrella assembly structure that improves structural integrity and stability of the canopy with respect to a support post, without compromising the extent and/or ease of collapsing the canopy frame.

SUMMARY OF THE INVENTION

The present invention overcomes the drawbacks in the prior art, by providing stabilizing struts for supporting the canopy with respect to the support post, without compromising the extent and/or ease of collapsing the canopy frame.

The present invention provides an umbrella assembly, comprising a post and a canopy stabilized with additional struts coupled between the canopy and the post.

In one aspect, the post has a first pivot joint, and a second pivot joint that moves relative to the first pivot joint to open/extend and close/collapse the canopy. In one embodiment, the post has a base section and an extendible section slidably coupled to and extendible from the base section, wherein the base section has a first pivot joint, and the extendible section has a second pivot joint that moves relative to the first pivot joint as the extendible section slides relative to the base section. The canopy comprises a collapsible frame assembly, wherein: the frame assembly comprises a plurality of long ribs pivotally coupled to each other at one end of each long rib at a top hub, and a plurality of short ribs pivotally coupled to each other at one end of each short rib at a lower hub, another end of each short rib is pivotally coupled to a corresponding long rib, one of the long rib is a support arm, another end of the support arm is pivotally coupled to the first pivot joint at the base section of the post, and the frame assembly collapses from an opened/extended configuration to a closed/collapsed configuration by pivoting the long ribs with respect to the short ribs with the top hub moving away/apart from the bottom hub.

The umbrella assembly further comprises a first strut and a second strut each having a first end and a second end, wherein the first end of the first strut and the first end of the second strut are pivotally coupled (e.g., with a spherical bearing) to the second pivot joint at the extendible section of the post, and wherein the second end of the first strut is pivotally coupled (e.g., with a spherical bearing) to a first long rib adjacent to one side of the support arm, and the second end of the second strut is pivotally coupled (e.g., with a spherical bearing) to a second long rib adjacent to another side of the support arm, thereby stabilizing the canopy with respect to the post.

In one embodiment, the umbrella assembly comprises a third strut and a fourth strut to further stabilize the canopy with respect to the post. The third strut and the fourth strut each has a first end and a second end, wherein the first end of the third strut and the first end of the fourth strut are pivotally coupled (e.g., with a spherical bearing) to the first pivot joint at the base section of the post, and wherein the second end of the third strut is pivotally coupled (e.g., with a spherical bearing) to the first strut and the second end of the fourth strut is pivotally coupled (e.g., with a spherical bearing) to the second strut, thereby further stabilizing the canopy with respect to the post.

The umbrella assembly may further comprise a support strut having a first end pivotally coupled to the second pivot joint at the extendible section of the post, and a second end pivotally coupled to the support arm. The combination of struts provides a structure with improved stability.

In another embodiment, instead of coupling to the first pivot joint at the base section of the post, the first end of the third strut and the first end of the fourth strut are instead pivotally coupled with freedom of rotation about at least one or more (e.g., two) orthogonal axis (e.g., with a spherical bearing) to the support strut that is pivotally coupled between the second pivot joint and the support arm, thereby stabilizing the canopy with respect to the post.

Given the pivotal couplings and joints, the collapsible frame can be closed/collapsed upon extending the extendible section to move the second pivot joint away from the base section, and the collapsible frame can be opened/extended upon retracting the extendible section to move the second pivot joint towards the base section.

In one embodiment, the top hub and the bottom hub are telescopically coupled.

The first pivot joint and the second pivot joint are supported to be moved away from each other to close/collapse the canopy frame assembly, and to be moved towards each other to open/extend the canopy frame assembly. In one embodiment, the extendible section and the base section of the post are telescopically coupled or slidable track coupled, and the second pivot joint is disposed on the extendible section (e.g., at or near the distal end of the extendible section) of the post and the first pivot joint is disposed on the base section of the post. In one embodiment, the base section is stationary, and the extendible section is movable to extend relative to the base section, thereby extending the overall length of the post to move the second pivot joint on the extendible section of the post away from the first pivot joint on the base section of the post so as to close/collapse the canopy frame assembly, and contracting the overall length of the post to move the second pivot joint on the extendible section of the post towards the first pivot joint on the base section of the post so as to open/extend the canopy frame assembly.

In another embodiment, the first pivot joint is slidable coupled to the post. Instead of a telescopic post having an extendible section and a base section and moving the extendible section to move the second pivot joint on the extendible section of the post, the post is fixed length with the second pivot joint is fixedly disposed at or near the distal top end of the post and the first pivot joint is slidably coupled to along the post below the second pivot joint to change the distance between the second pivot joint and the first pivot joint. For example, the first pivot joint may be slidably coupled to the post by means of a track along which the first pivot joint is slidably attached. The first pivot joint may be actuated to move towards and away from the second pivot joint (to open/extend and close/collapse the canopy frame assembly) by means of an appropriate linear actuator, e.g., comprising a linear bearing arrangement, a worm gear arrangement, a lead screw arrangement, a cable drive, etc.

In a further embodiment, both the first pivot joint and the second pivot joint may be movable towards and away from each other to open/extend and close/collapse the canopy frame assembly. In one embodiment, both the first pivot joint and the second pivot joint may be both slidably coupled to a fixed length post. In another embodiment, the second pivot joint may be fixedly disposed at or near the top end of an extendible section of the post and the first pivot joint is slidably coupled to along a base section of the post. The extendible section and the base section are telescopically coupled or slidable track coupled.

In one embodiment, the spherical bearing may include a fisheye bearing.

The inventive umbrella assembly provides a simple, reliable and easy to operate structure that improves structural integrity and stability of the canopy with respect to a support post, without compromising the extent and/or ease of collapsing the canopy frame.

BRIEF DESCRIPTION OF THE DRAWINGS

For a fuller understanding of the nature and advantages of the invention, as well as the preferred mode of use, reference should be made to the following detailed description read in conjunction with the accompanying drawings.

DETAILED DESCRIPTION OF THE PREFERRED EMBODIMENTS

This invention is described below in reference to various embodiments with reference to the figures. While this invention is described in terms of the best mode for achieving this invention's objectives, it will be appreciated by those skilled in the art that variations may be accomplished in view of these teachings without deviating from the spirit or scope of the invention.

The present invention overcomes the drawbacks in the prior art, by providing stabilizing struts for supporting the canopy with respect to the support post. The present invention provides an umbrella assembly, comprising a post and a canopy stabilized with additional struts coupled between the canopy and the post.

The present invention will be described herein-below in reference to umbrellas of the type designed and structured for use to provide shade to a relatively large area, such as in a garden or patio area. This type of umbrellas is generally referred to as patio umbrellas. However, it is understood that the present invention could be applied to umbrellas for other applications, currently known or future discovered, without departing from the scope and spirit of the present invention.

Figure 1:
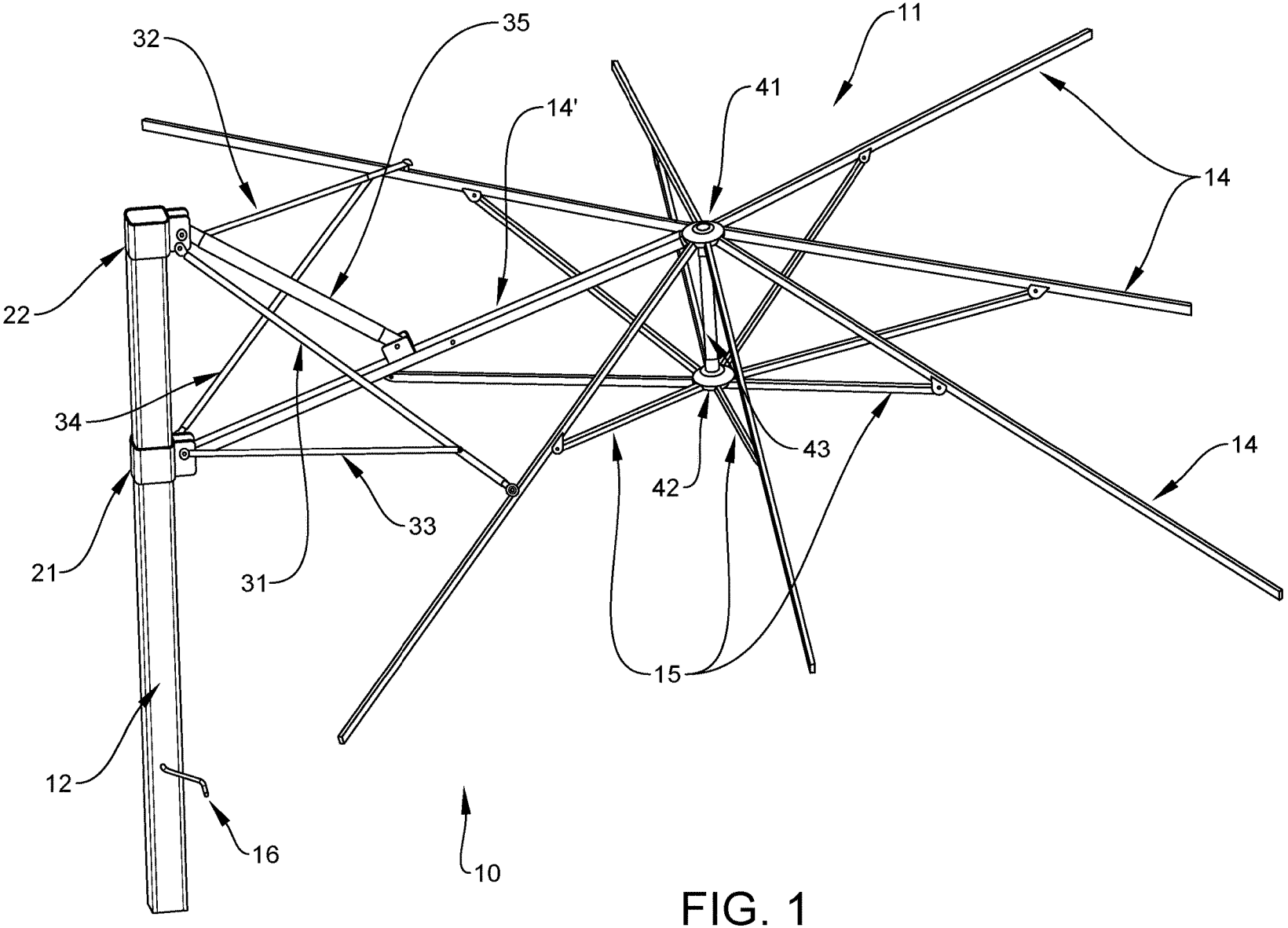
FIG. 1 is a schematic perspective view illustrating an umbrella assembly with its canopy frame assembly in a fully opened configuration in accordance with one embodiment of the present invention.
Figure 2:
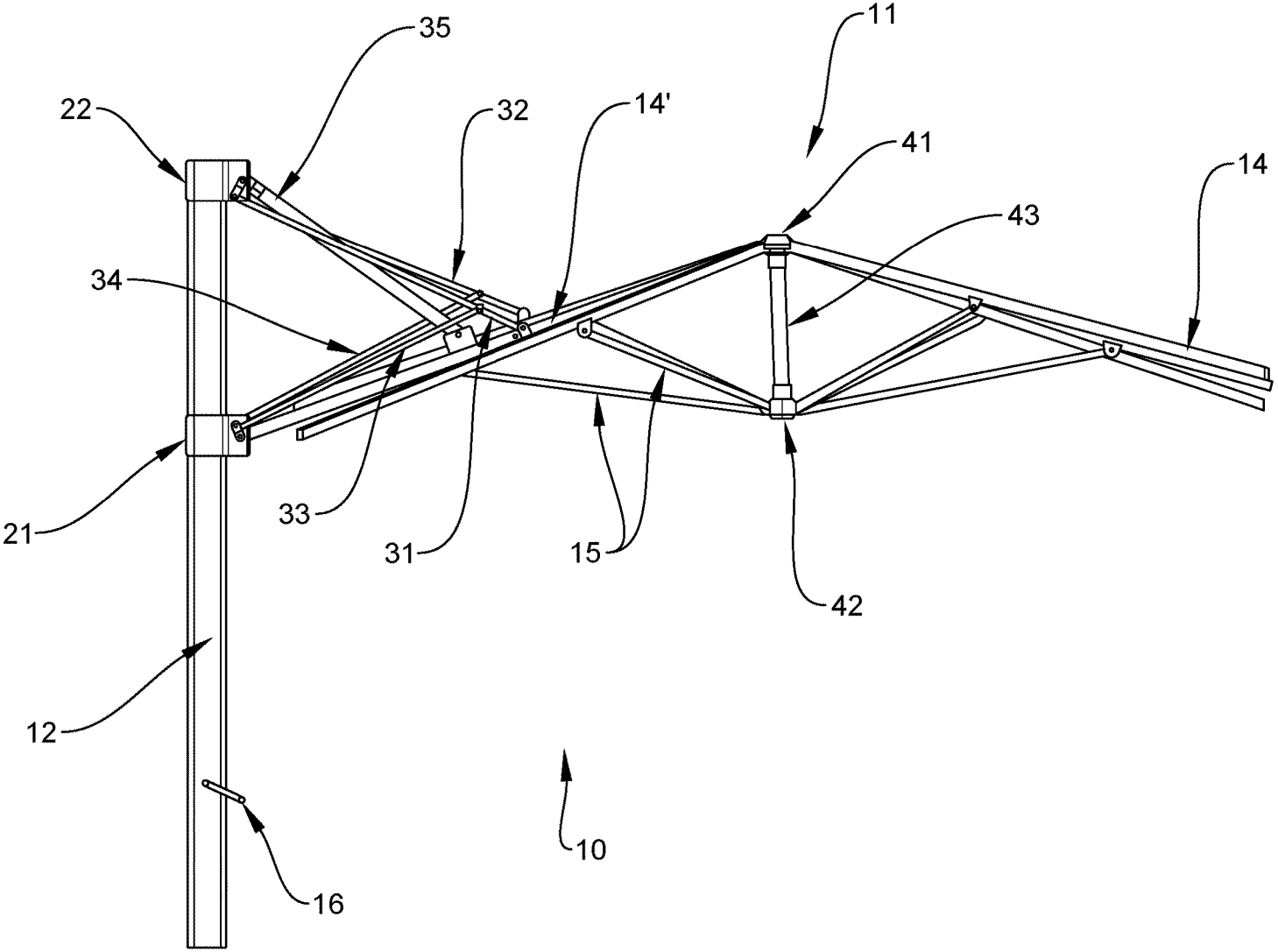
FIG. 2 is a side view of the umbrella assembly in FIG. 1.
Figure 3:
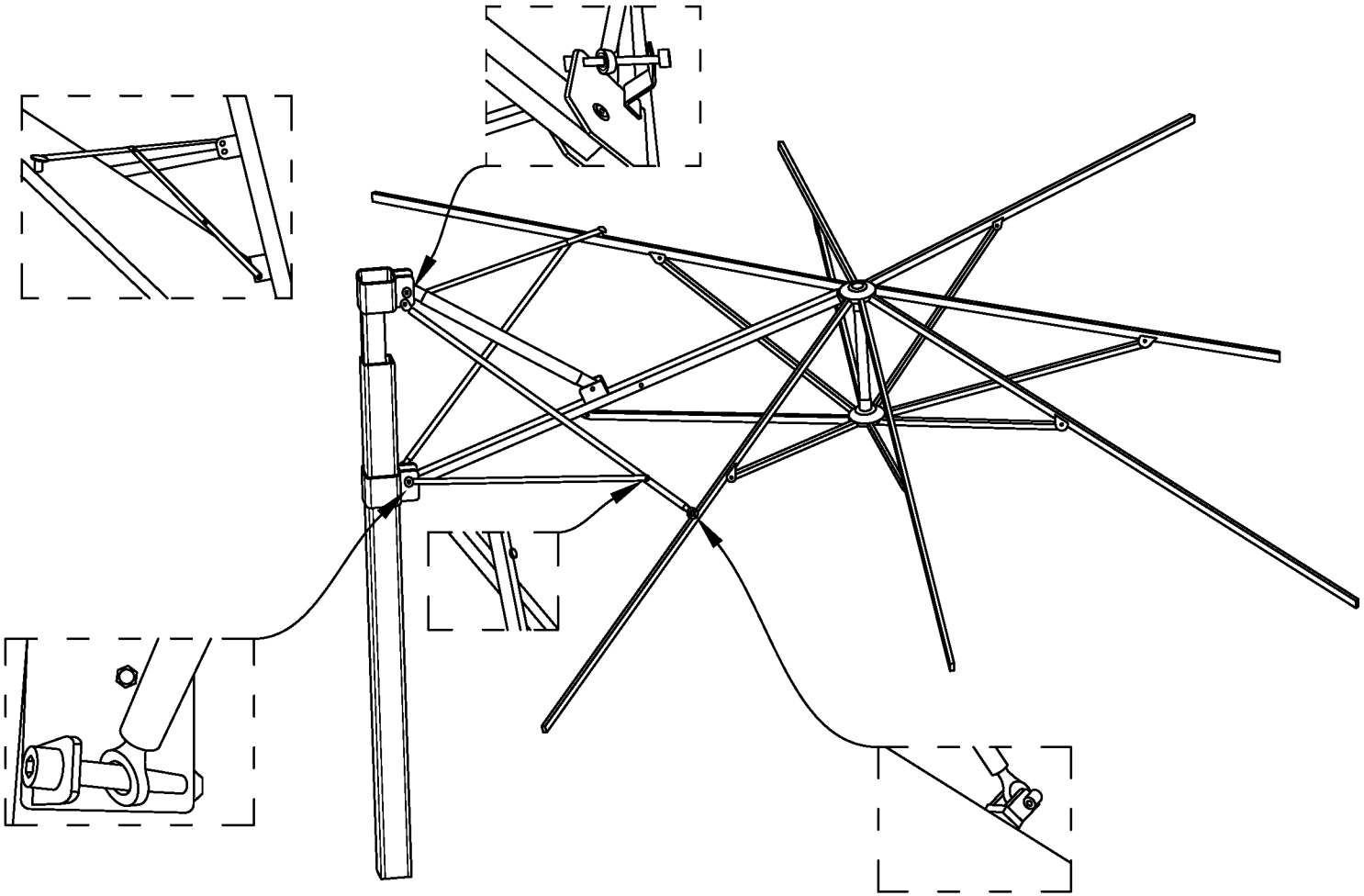
FIG. 3 is a perspective view of the umbrella assembly in FIG. 1, with enlarged views of exemplary bearings shown.

Referring to the embodiment of FIGS. 1-3, the umbrella assembly 10 generally comprises a heavy anchoring base (not shown, e.g., a concrete or metal block) supporting an upwardly (e.g., vertical or at an angle to the vertical) extending post (e.g., straight, but may be curved). The post has a base section 12 and an extendible section slidably coupled to and extendible from the base section 12 (e.g., the extendible section 13 is telescopically extending from the base section 12 of the post). A first pivot joint 21 located at a fixed location along the base section 12 of the post, and the extendible section 13 of the post, and a second pivot joint 22 is located at or near a distal end of the extendible section 13 of the post. The second pivot joint 22 therefore moves relative to the first pivot joint 21 as the extendible section 13 slides relative to the base section 12 of the post.

The canopy includes a collapsible frame assembly 11. The frame assembly 11 comprises a framework of long ribs 14, short ribs 15, and a support hub (comprising top hub 41, bottom hub 42, and hub interconnect 43). In the illustrated embodiment, a plurality of long ribs 14 are pivotally coupled to each other at one end of each long rib 14 at a top hub 41, and a plurality of short ribs 15 are pivotally coupled to each other at one end of each short rib 15 at a lower or bottom hub 42. The other end of each short rib 15 is pivotally coupled to a location along a corresponding long rib 14. As further illustrated in FIGS. 10-13, a shade comprising a flexible panel 18 (e.g., made of a heavy fabric such as canvas) covers and is supported by the frame assembly 11. The canopy frame assembly 11 may be generally symmetrical about the axis of the canopy's longitudinal central axis through the top hub 41 and the bottom hub 42.

In the illustrated embodiment, one of the long ribs 14 is a support arm 14'. The other end of this long rib/support arm 14' is pivotally coupled to the first pivot joint 21 at the base section of the post.

The shade can be opened (as in the state/configuration illustrated in FIGS. 1-3, 10 and 11) to provide shading, or closed for storage (as in the state/configuration illustrated in FIGS. 5 and 13), by manipulating the frame assembly. Specifically, the frame assembly collapses from an opened configuration to a collapsed configuration by pivoting the long ribs 14 with respect to the short ribs 15 with the bottom hub 42 moving away/apart from the top hub 41.

The umbrella assembly 10 further comprises a first strut 31 and a second strut 32 each having a first end and a second end, wherein the first end of the first strut 31 and the first end of the second strut 32 are pivotally coupled (e.g., with a spherical bearing) to the second pivot joint 22 at the extendible section of the post. The second end of the first strut 31 is pivotally coupled (e.g., with a spherical bearing) to a location along a first long rib 14 adjacent to one side of the support arm 14', and the second end of the second strut 32 is pivotally coupled (e.g., with a spherical bearing) to a location along a second long rib 14 adjacent to another side of the support arm 14'. The first and second struts 31 and 32 stabilize the canopy with respect to the post.

In the embodiment illustrated in FIGS. 1-3, the umbrella assembly 10 further comprises a third strut 33 and a fourth strut 34 each having a first end and a second end. The first end of the third strut 33 and the first end of the fourth strut 34 are pivotally coupled (e.g., with a spherical bearing) to the first pivot joint 21 at the base section of the post. The second end of the third strut 33 is pivotally coupled (e.g., with a spherical bearing) to a location along the first strut 31 and the second end of the fourth strut 34 is pivotally coupled (e.g., with a spherical bearing) to a location along the second strut 32. The third and fourth struts 33 and 34 in conjunction with the first and second struts 31 and 32 further stabilize the canopy with respect to the post.

As illustrated in FIG. 1-3, the umbrella assembly 10 may further comprise a support strut 35 having a first end pivotally coupled to the second pivot joint 22 at the extendible section of the post, and a second end pivotally coupled to a location along the support arm 14'.

Figure 4:
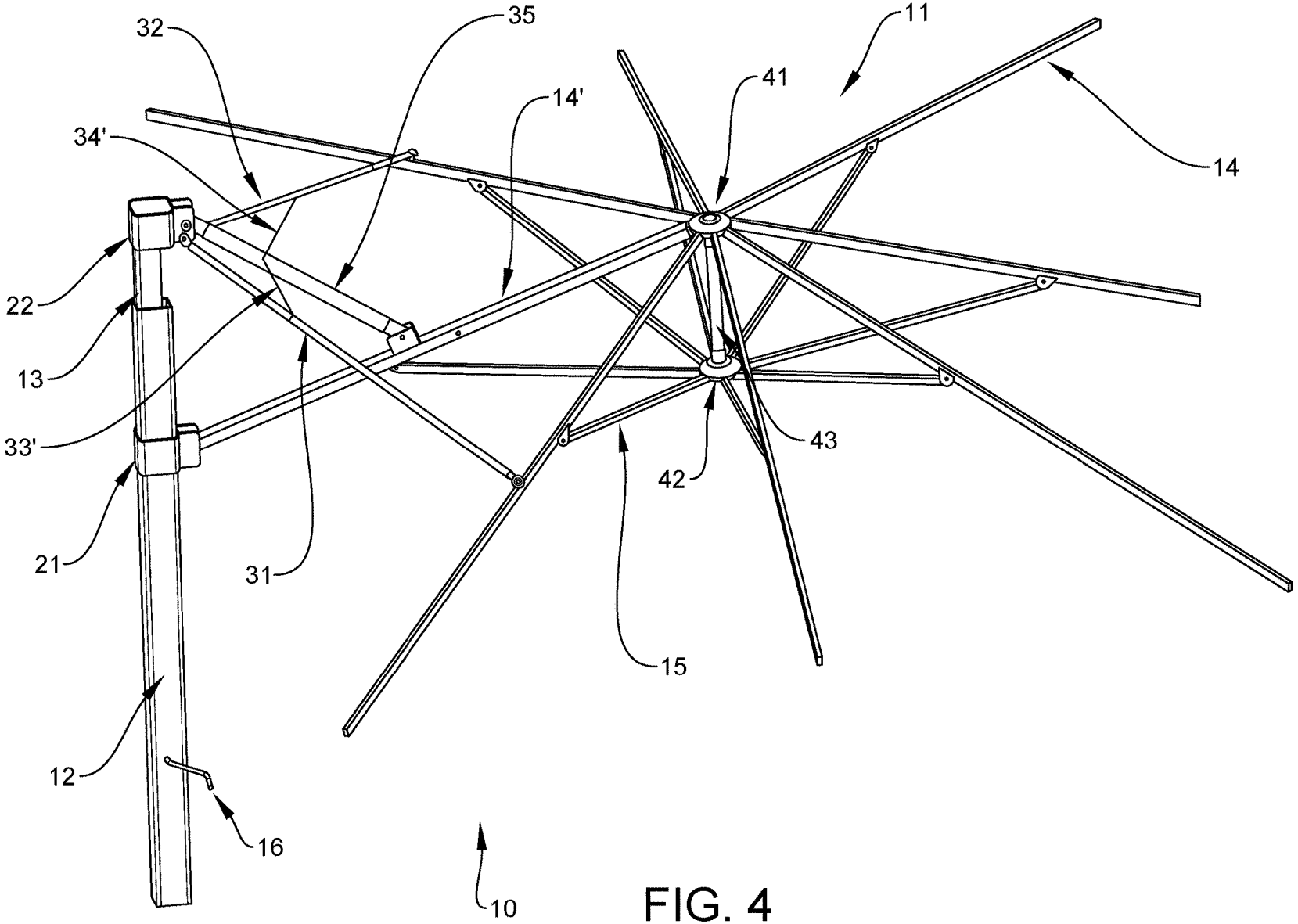
FIG. 4 is a schematic perspective view illustrating an umbrella assembly in accordance with another embodiment of the present invention.

In an alternate embodiment illustrated in FIG. 4, instead of coupling to the first pivot joint 21 at the base section of the post, the first end of the third strut 33' and the first end of the fourth strut 34' are instead pivotally coupled (e.g., with a spherical bearing) to the support strut 35 that is pivotally coupled between the second pivot joint 22 and the support arm 14', thereby stabilizing the canopy with respect to the post.

The combination of struts in accordance with the present invention provides a structure with improved stability.

Figure 5:
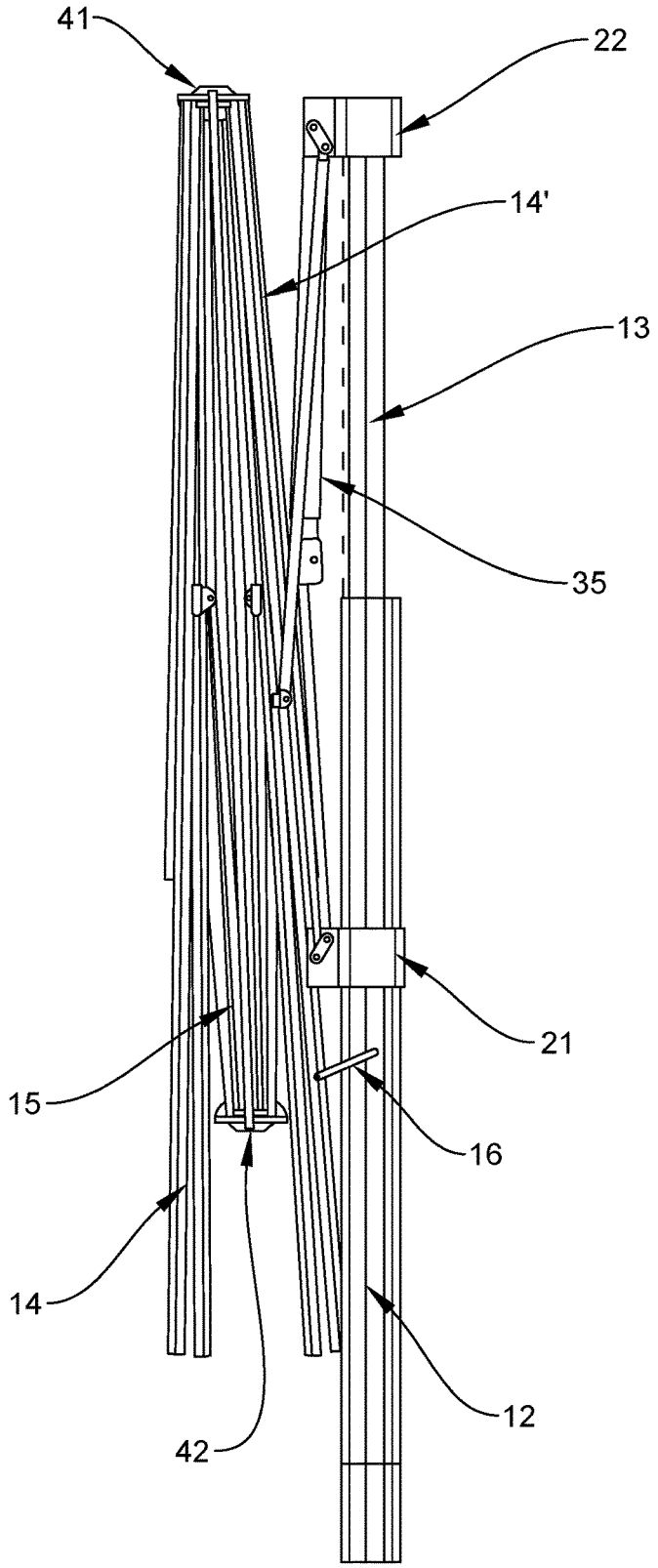
FIG. 5 is a side view of the umbrella assembly of FIG. 1 with its canopy frame assembly in a fully closed configuration.
Figure 7:
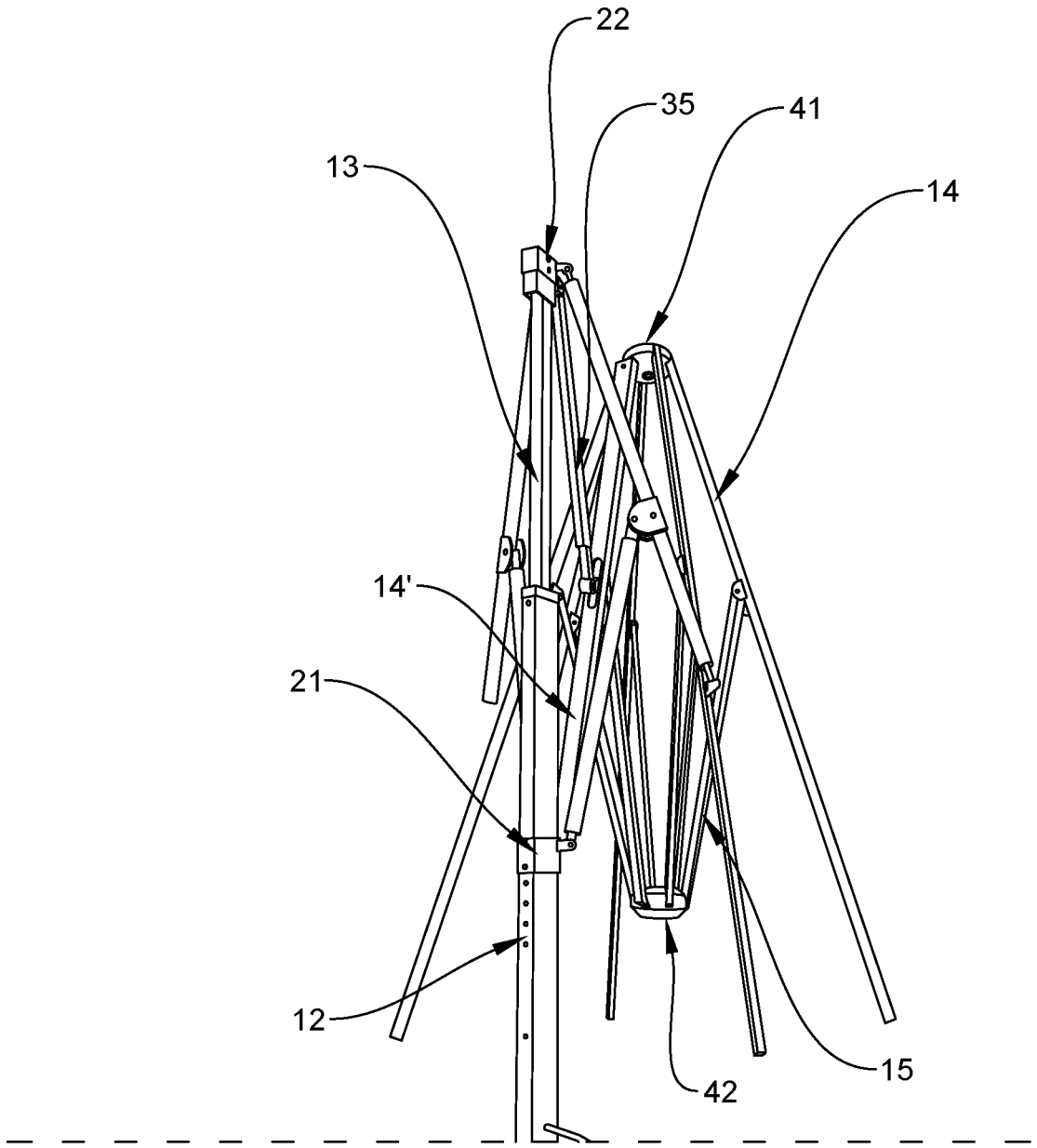
FIG. 7 is a photo image perspective view of the prototype umbrella assembly of FIG. 6 with its canopy frame assembly in its almost fully closed configuration.
Figure 12:
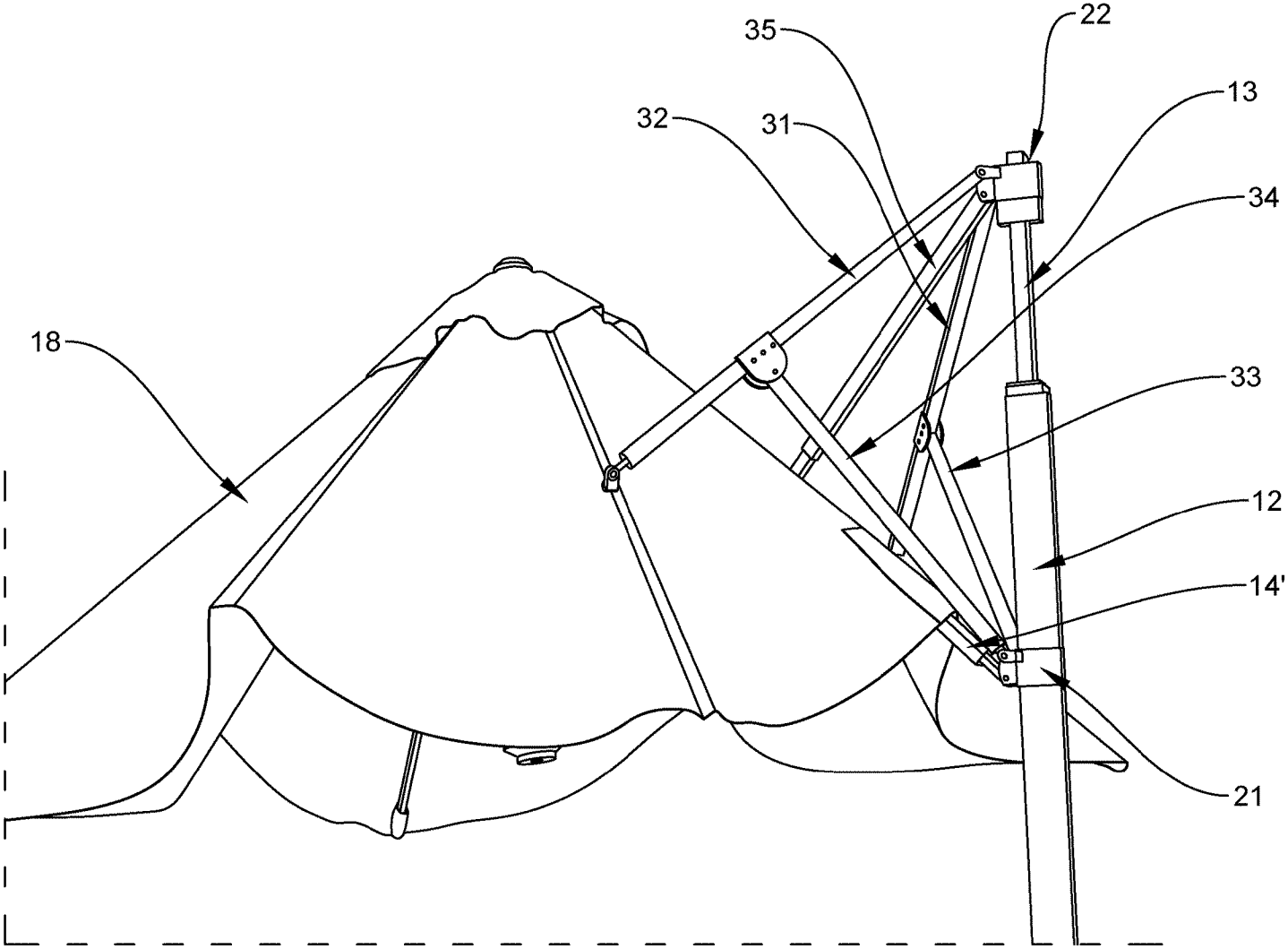
FIG. 12 illustrates a view of semi-closed configuration of the umbrella assembly of FIG. 10.
Figure 13:
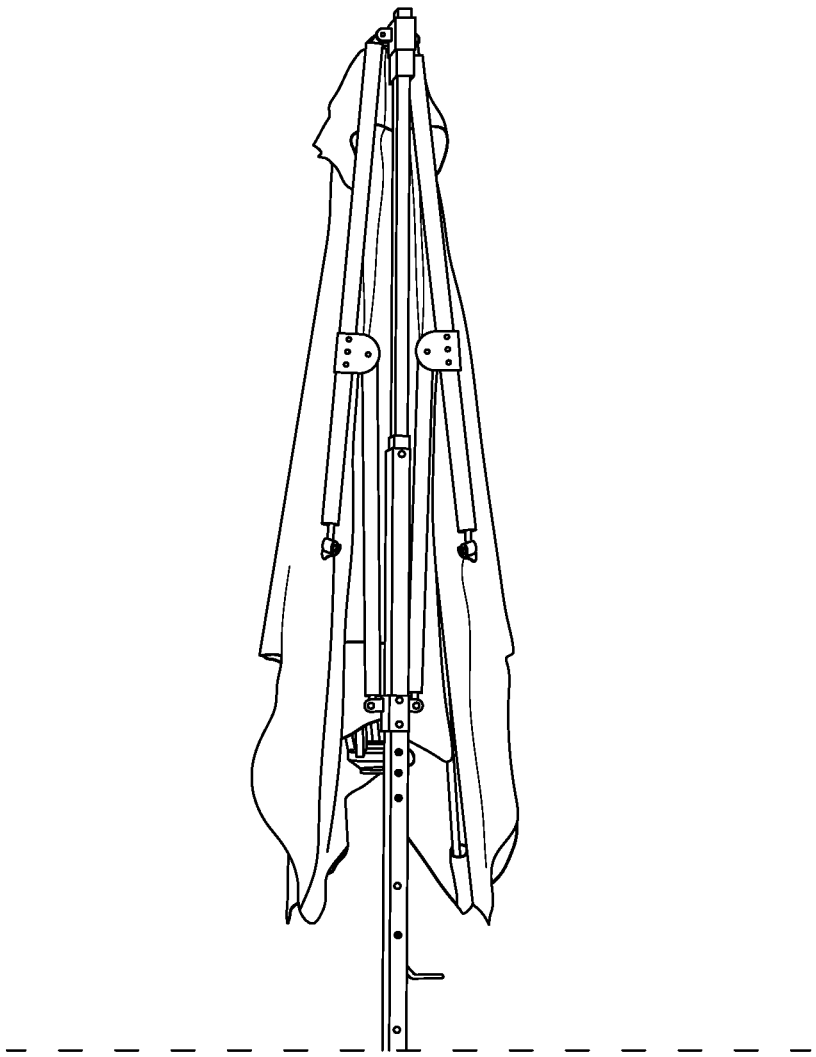
FIG. 13 illustrates a view of fully closed configuration of the umbrella assembly of FIG. 10.

Given the pivotal couplings and joints, the frame assembly can be collapsed upon extending the extendible section to move the second pivot joint 22 away from the base section, which result in the bottom hub 42 moving away/apart from the top hub 41. The resultant closed configuration of the frame assembly is depicted in FIG. 5 (and FIG. 13). The semi-closed (or semi-opened) configuration of the frame assembly is illustrated in FIG. 12. FIG. 7 illustrates an almost closed configuration of the frame assembly. Given the base section of the post is stationary, and the extendible section of the post is movable to extend relative to the base section of the post, the overall length of the post is extended in the closed configuration of the frame assembly.

In reverse, the frame assembly can be opened upon retracting the extendible section of the post to move the second pivot joint 22 towards the base section of the post.

In one embodiment, the extendible section and the base section of the post are telescopically coupled. Alternately, the extendible section and the base section of the post may be slidably coupled by a track coupling.

The relative movements of the first pivot joint 21 and the second pivot joint 22 (e.g., movement of the extendible section of the post supporting the second pivot joint 22) may be actuated by a mechanical drive, e.g., a rack and pinion drive, a cable drive, a track drive, a linear gear drive, or other suitable linear drive known in the art. A hand crank 16 may be provided (as schematically shown in FIG. 1) to facilitate a user to actuate the drive to extend and retract the extendible section from the base section of the post. Alternatively, an electrical motor drive may be provided to provide an electro-mechanical drive.

As shown in the illustrated embodiments, the first pivot joint 21 and the second pivot joint 22 are supported to be moved away from each other to close/collapse the canopy frame assembly, and to be moved towards each other to open/extend the canopy frame assembly. In the illustrated embodiments, the extendible section and the base section of the post are telescopically coupled, and the second pivot joint 22 is disposed on the extendible section (e.g., at or near the distal end of the extendible section) of the post and the first pivot joint 21 is disposed on the base section of the post. In the illustrated embodiments, the base section is stationary, and the extendible section is movable to extend relative to the base section, thereby extending the overall length of the post to move the second pivot joint 22 on the extendible section of the post away from the first pivot joint 21 on the base section of the post so as to close/collapse the canopy frame assembly, and contracting the overall length of the post to move the second pivot joint 22 on the extendible section of the post towards the first pivot joint 21 on the base section of the post so as to open/extend the canopy frame assembly.

In another embodiment, the first pivot joint 21 is slidable coupled to the post. Instead of a telescopic post having an extendible section and a base section and moving the extendible section to move the second pivot joint 22 on the extendible section of the post, the post is fixed length with the second pivot joint 22 is fixedly disposed at or near the distal top end of the post and the first pivot joint 21 is slidably coupled to along the post below the second pivot joint 22 to change the distance between the second pivot joint 22 and the first pivot joint 21. For example, the first pivot joint 21 may be slidably coupled to the post by means of a track along which the first pivot joint 21 is slidably attached. The first pivot joint 21 may be actuated to move towards and away from the second pivot joint 22 (to open/extend and close/collapse the canopy frame assembly) by means of an appropriate linear actuator, e.g., comprising a linear bearing arrangement, a worm gear arrangement, a lead screw arrangement, etc.

In a further embodiment, both the first pivot joint 21 and the second pivot joint 22 may be movable towards and away from each other to open/extend and close/collapse the canopy frame assembly. In one embodiment, both the first pivot joint 21 and the second pivot joint 22 may be both slidably coupled to a fixed length post. In another embodiment, the second pivot joint 22 may be fixedly disposed at or near the top end of an extendible section of the post and the first pivot joint 21 is slidably coupled to along a base section of the post. The extendible section and the base section are telescopically coupled.

Figure 6:
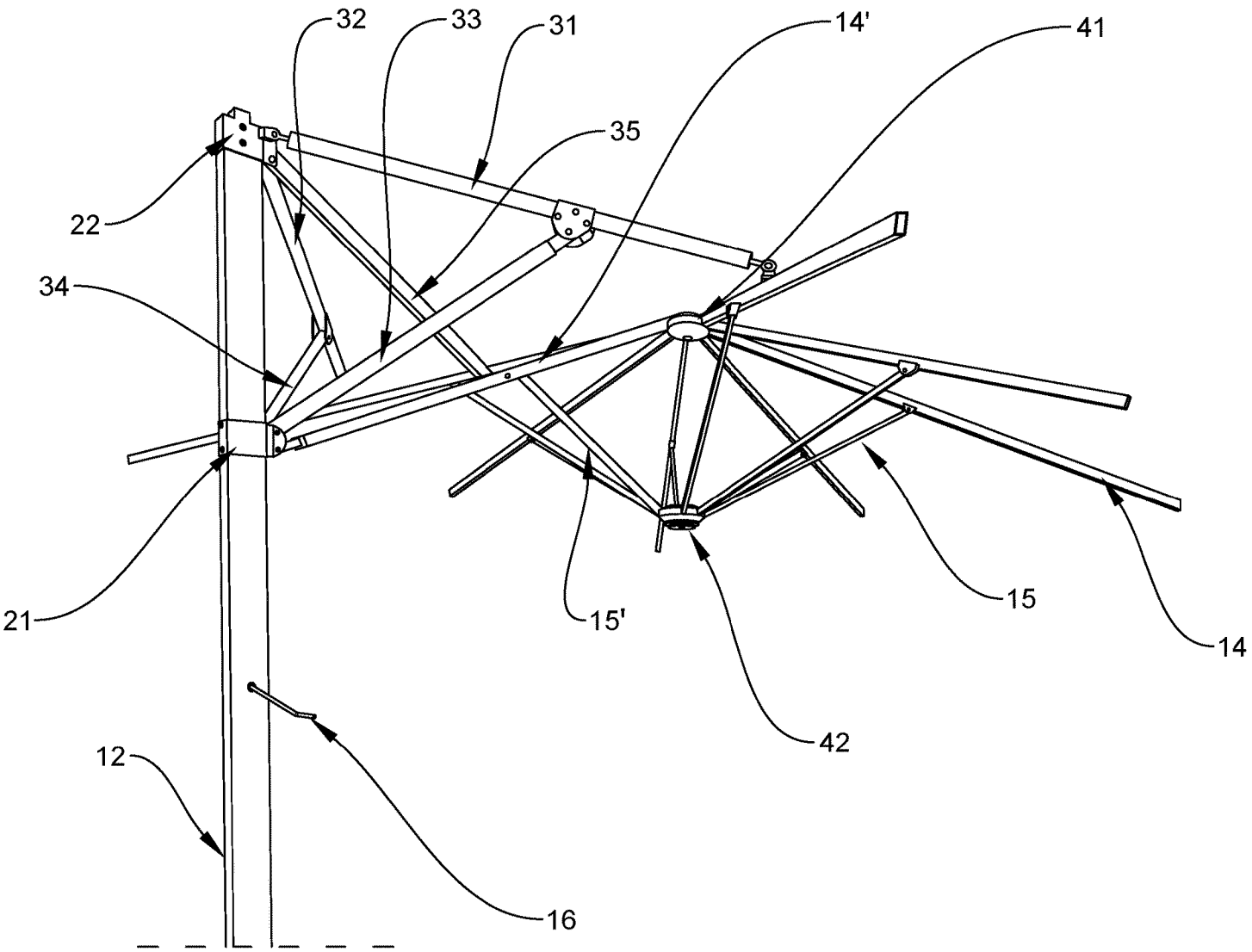
FIG. 6 is photo image perspective view of a prototype umbrella assembly with its canopy frame assembly in a fully opened configuration in accordance with another embodiment of the present invention.
Figure 11:
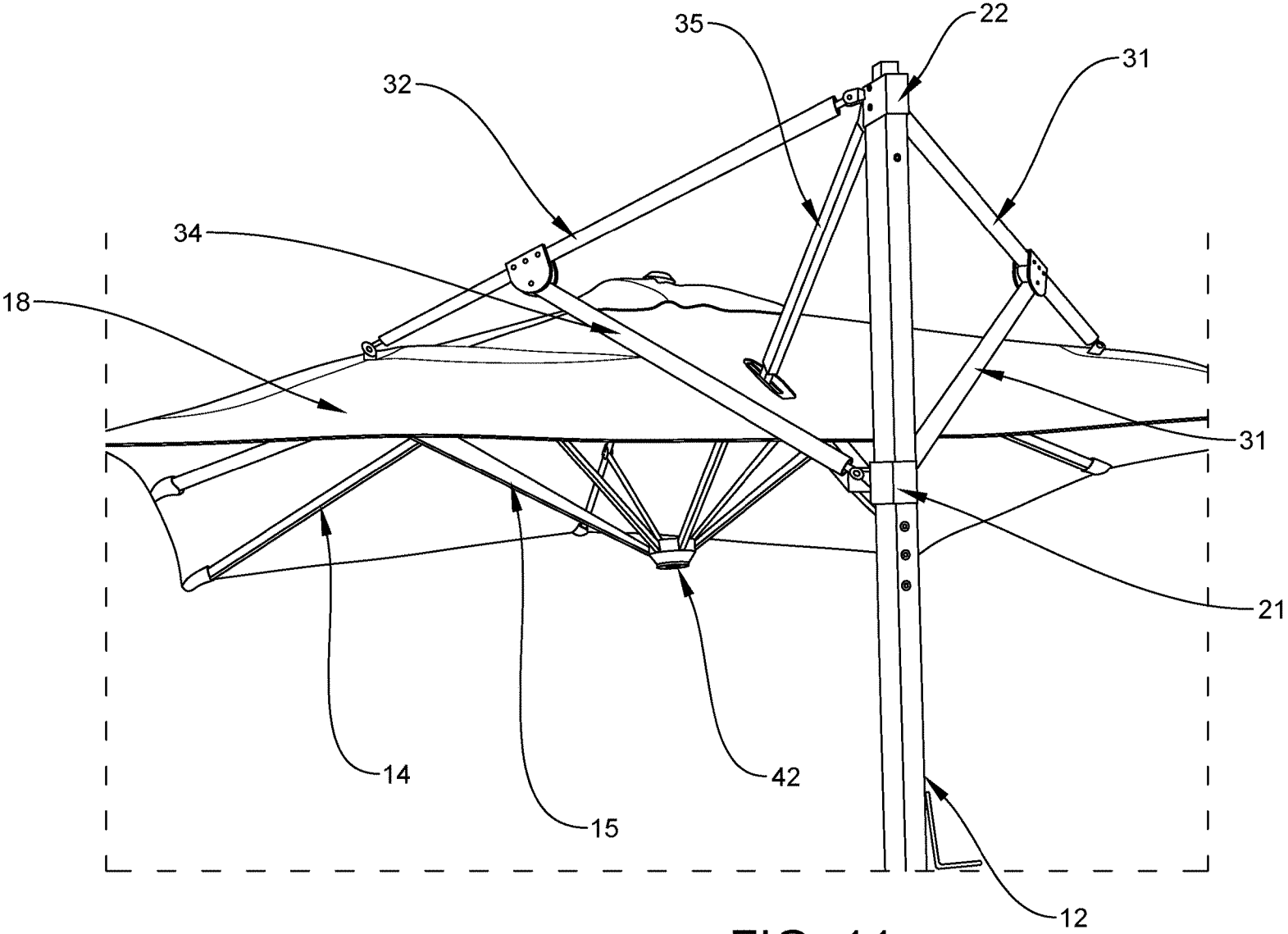
FIG. 11 illustrates another view of the umbrella assembly of FIG. 10.

In the embodiment of FIGS. 1-5, the top hub 41 and the bottom hub 42 are directly coupled (e.g., telescopically coupled) by a hub-interconnect (e.g. a runner structure or a telescopic tube known in the art). In the embodiments of FIGS. 6-7 and FIGS. 10-14, the top hub 41 and the bottom hub 42 are not directly connected. Instead the top hub 41 and the bottom hub 42 are suspended apart by the pivoted/hinged structure of the long and short ribs 14 and 15. The network of pivoted/hinged ribs opens and closes/collapses the canopy frame as the first and second pivot joints 21 and 22 moves relative to each other. More specifically, from an opened position as shown in FIGS. 6 and 11, as the first pivot joint 21 and the second pivot joint 22 move away from each other, the support strut 35 and the first and third struts 31 and 33 cause the long ribs 14 (including the support arm 14' and its immediate adjacent long ribs 14) to draw closer as they move towards the vertical, and in turn cause the short ribs 15 to draw closer as they move towards the vertical, transitioning through the configuration shown in FIGS. 7 and 12, ending in the collapsed configuration shown in FIGS. 5 and 13. In the embodiment of FIGS. 1-5, the canopy frame assembly may be similarly structured without requiring the direct connection between the top hub 41 and the bottom hub 42.

Figure 14:
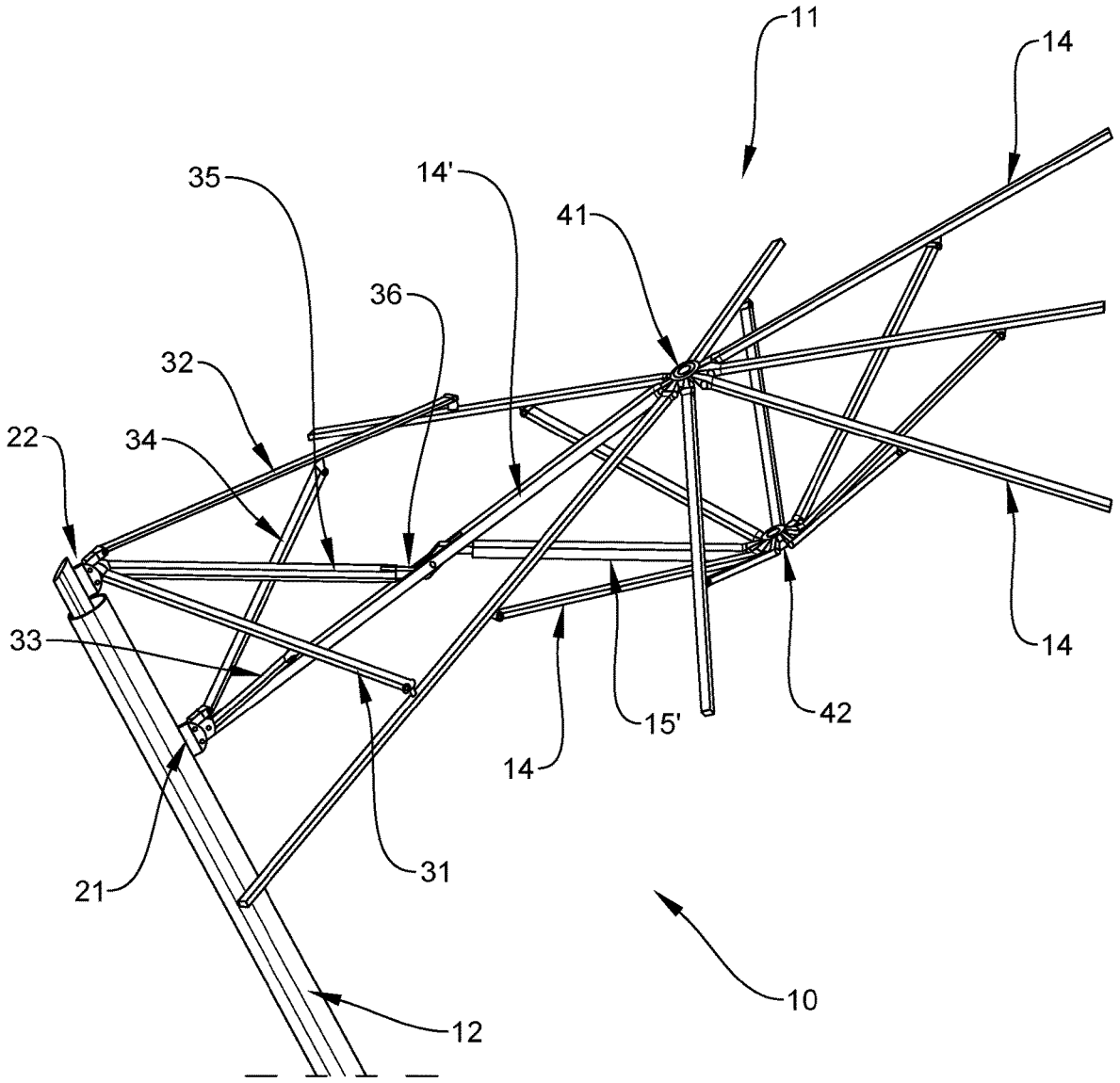
FIG. 14 is a schematic perspective view illustrating an umbrella assembly in accordance with yet another embodiment of the present invention.
Figure 15:
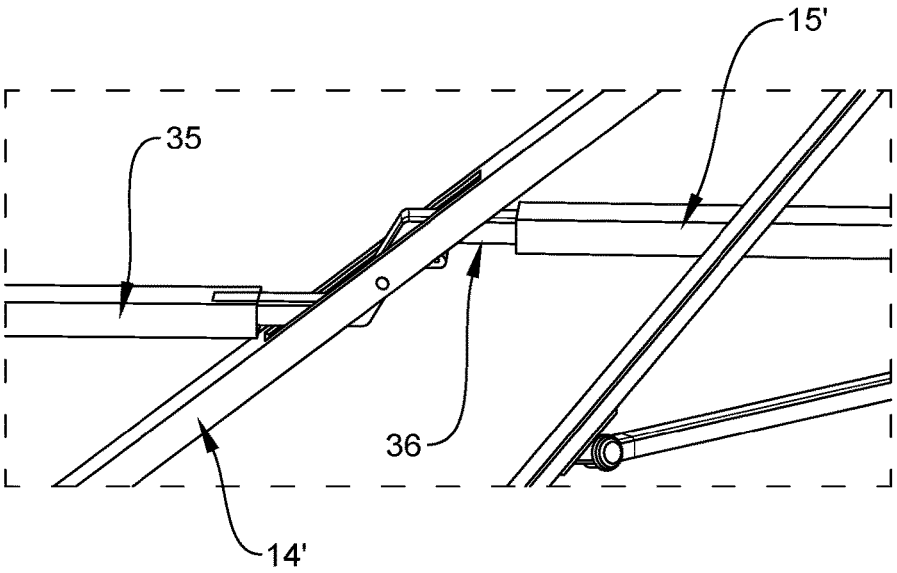
FIG. 15 is an enlarged partial perspective view illustrating the "scissor" hinge of the embodiment in FIG. 14.
Figure 16:
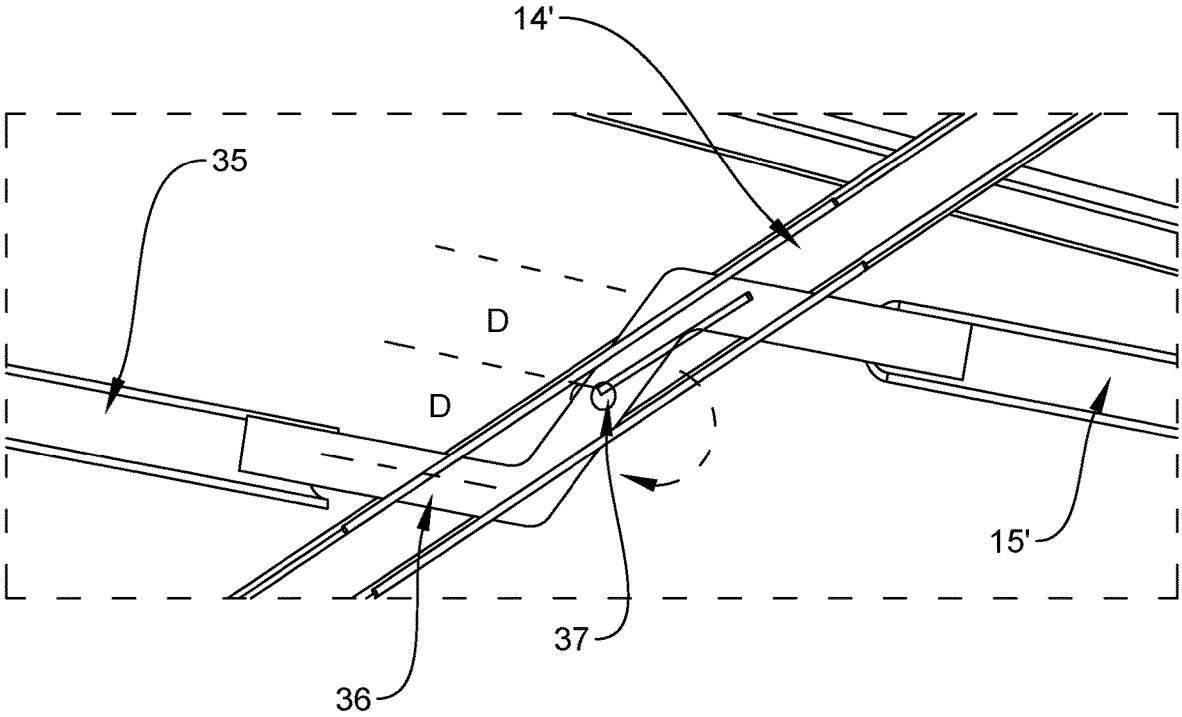
FIG. 16 is a sectional view illustrating the "scissor" hinge of the embodiment of FIG. 14.

FIG. 6 is photo image perspective view of a prototype umbrella assembly with its frame assembly in a fully opened configuration in accordance with another embodiment of the present invention. FIG. 14 is a schematic perspective view illustrating an umbrella assembly 110 in accordance with the embodiment of FIG. 6, without the shade installed. Unlike in the previous embodiment of FIG. 1 in which the support strut 35 and the short rib 15 are separately pivotal coupled to the support arm 14', in the embodiment of FIGS. 6 and 14, the support strut 35 and the short rib 15' are interconnected with a coupling bar 36 that is pivoted at a location along the support arm 14' (a long rib 14 of the canopy frame assembly), thereby forming a "scissor" like (or "X") configuration with the support arm 14'. FIG. 15 is an enlarged partial perspective view illustrating the "scissor" hinge of the embodiment in FIG. 14. FIG. 16 is a sectional view illustrating the "scissor" hinge of the embodiment of FIG. 14. As shown in FIG. 16, the support strut 35 is connected to one end of the coupling bar 36, and the short rib 15' is connected to another end of the coupling bar 36. In this embodiment, the coupling bar 36 is shown to be in a "Z" configuration, to provide an offset distance D between the pivot/hinge 23 and the connection to the support strut 35' and the support arm 14', to provide clearance to facilitate pivoting of the coupling bar 36 in a clockwise direction to collapse the canopy frame from the opened configuration depicted in FIG. 16 (corresponding to FIGS. 14 and 15). In this embodiment, the support strut 35 and the corresponding short rib 15' pivot in unison with respect to the support arm 14'. In this embodiment, the top hub 41 and the bottom hub 42 are not directly connected (i.e., without a telescopic tube or guide).

Figure 17:
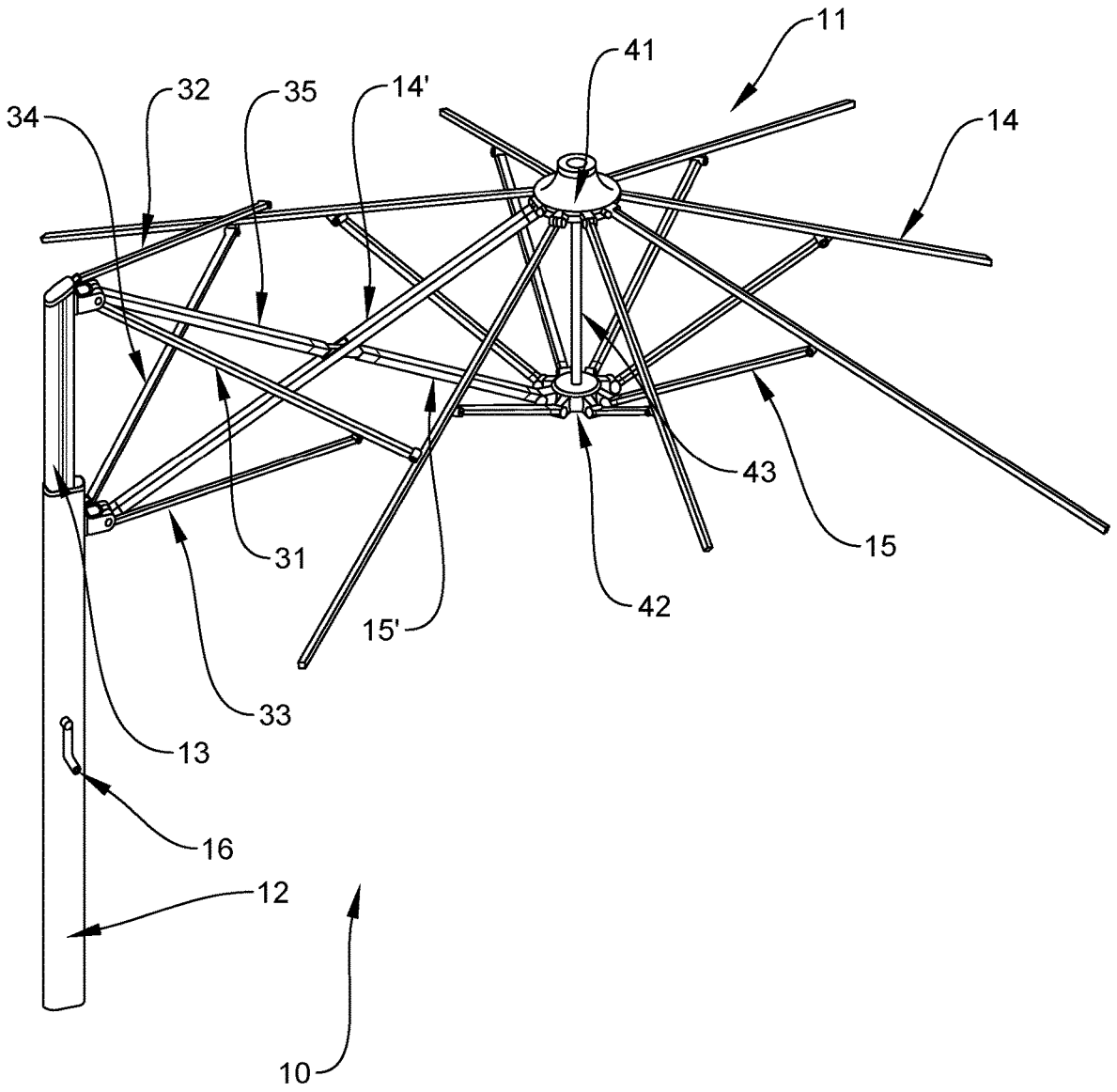
FIG. 17 is a schematic perspective view illustrating an umbrella assembly having a "scissor" hinge in accordance with still another embodiment of the present invention.

FIG. 17 is a schematic perspective view illustrating an umbrella assembly having a "scissor" hinge in accordance with still another embodiment of the present invention. The "scissor" hinge is similar to the embodiment shown in FIGS. 14-16. In this embodiment, the top hub 41 and the bottom hub 42 are directly connected with a hub interconnect 43 (e.g., with a telescopic tube or guide).

Figure 18:
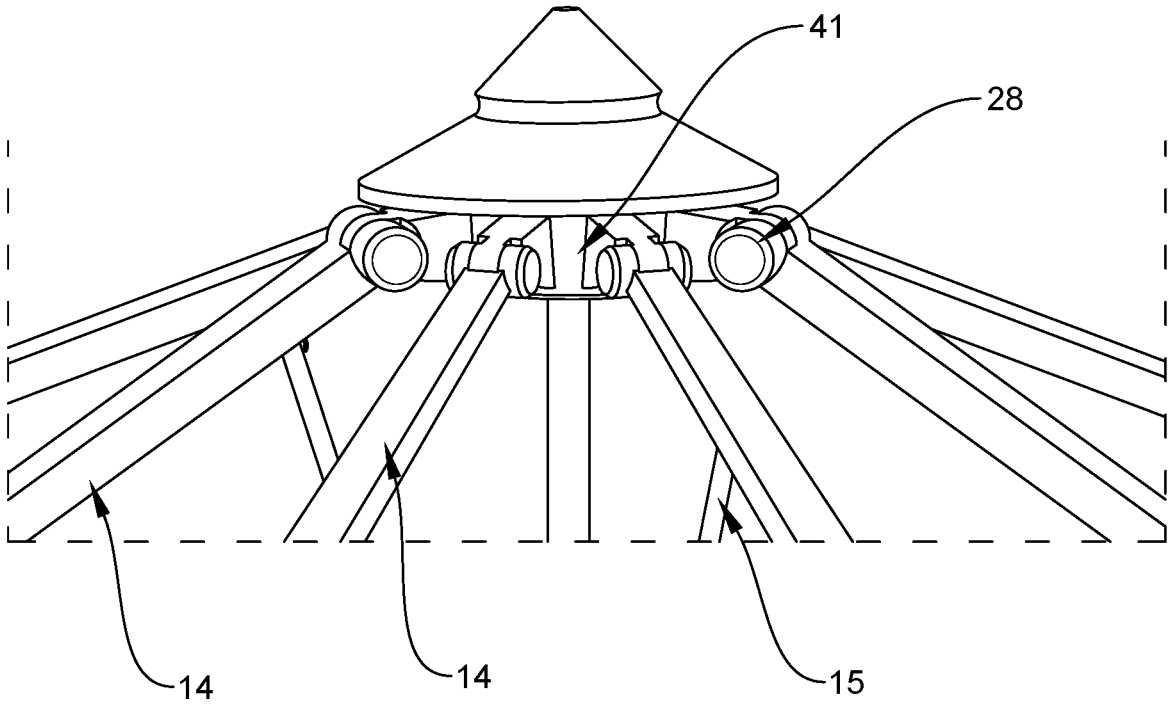
FIG. 18 is an enlarged partial view of the pivot hinges between the long ribs to the top hub in accordance with one embodiment of the present invention.

FIG. 18 is an enlarged partial view of the pivotal coupling between the long ribs 14 to the top hub 41 in accordance with one embodiment of the present invention. The pivotal coupling 28 of the short ribs 15 to the bottom hub 42 may be similar.

Figure 8:
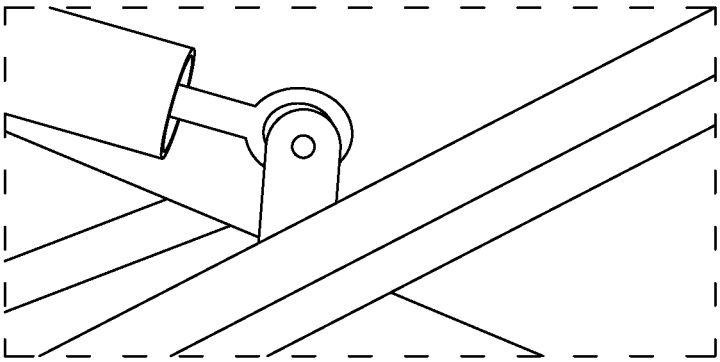
FIG. 8 is an enlarged view of a spherical bearing attached to a strut and a support arm of the canopy frame assembly of the umbrella assembly of FIG. 6.
Figure 9:
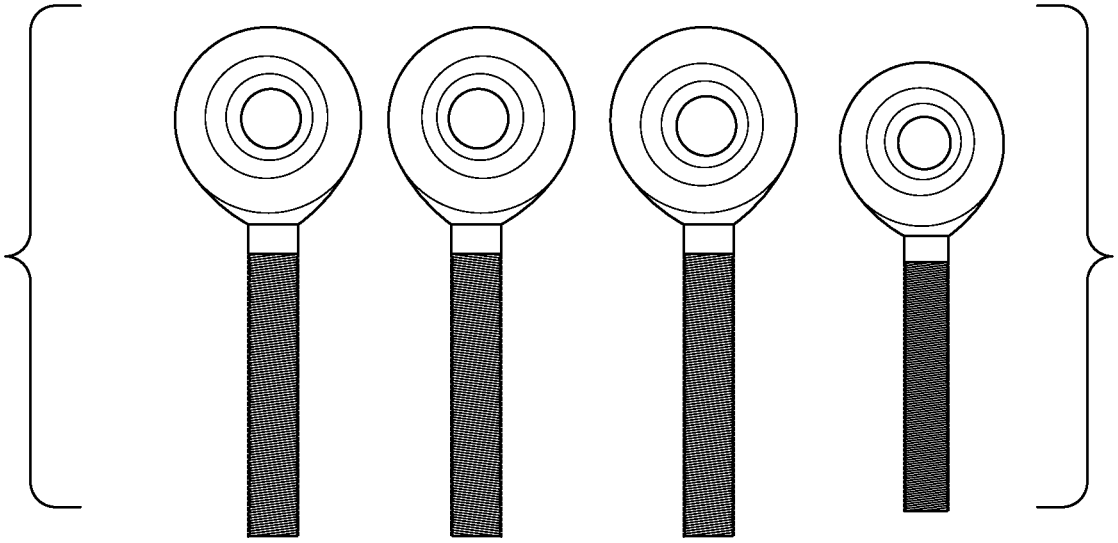
FIG. 9 illustrates various examples of spherical bearings or fisheye or rod end bearings.
Figure 10:
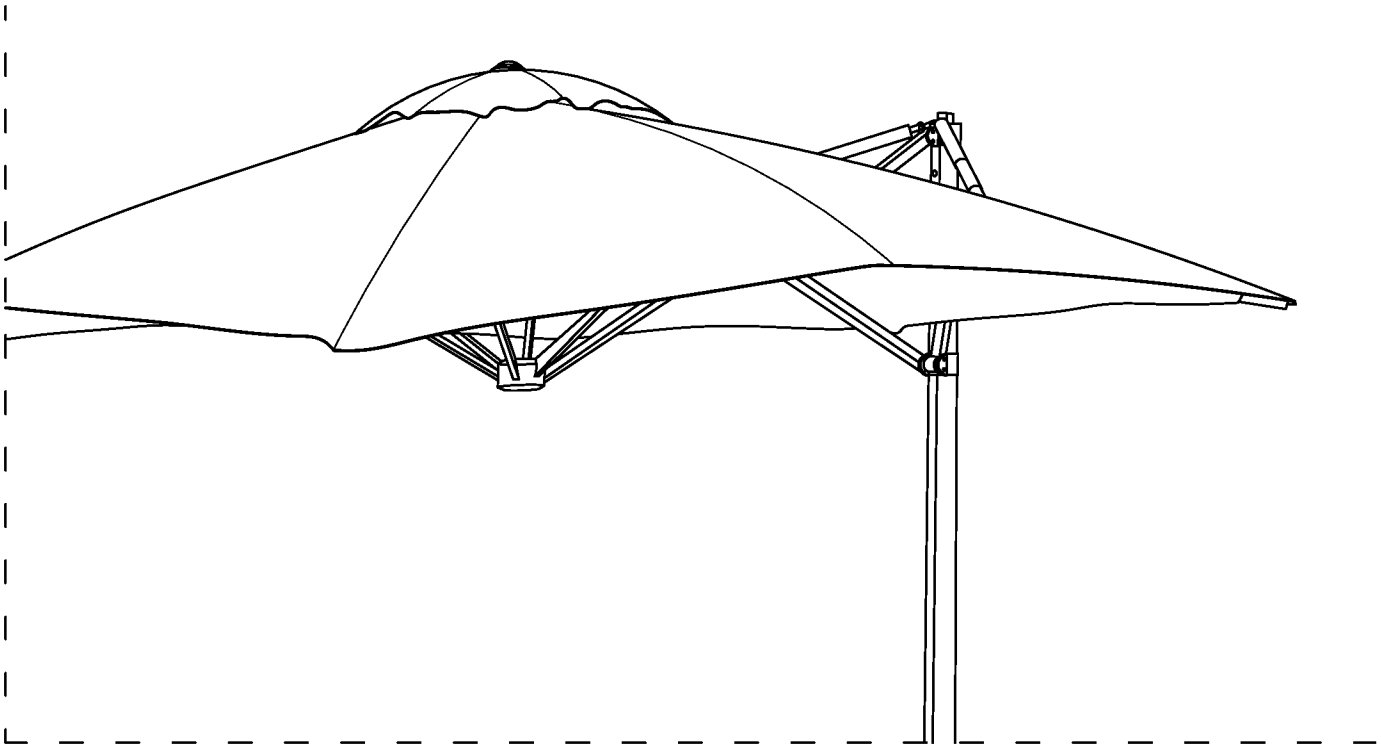
FIG. 10 illustrates an umbrella assembly having canopy its frame assembly covered by a flexible panel and in a fully opened configuration in accordance with one embodiment of the present invention.

FIGS. 8 and 9 illustrate examples of spherical bearings for coupling the struts to the long ribs 14 and/or first and second pivot joints 21 and 22. As known in the art, a spherical bearing is a mechanical articulating joint that permits angular rotation about a central point in two orthogonal directions (usually within a specified angular limit based on the bearing geometry). Typically, these bearings support a rotating shaft in the bore of the inner ring that must move not only rotationally, but also at an angle. A ball swivel with an opening through which a bolt or other attaching hardware may pass is pressed into a circular casing with a threaded shaft attached. The threaded portion may be either male or female. A spherical bearing allows rotational motion to change the alignment of its rotation axis. The spherical joint permits the rod or bolt passing through it to be misaligned to a limited degree (an angle other than 90 degrees). Examples of spherical bearings include what is commonly known as a "fisheye bearing", and/or a rod end bearing, also known as a "heim joint" (in North America) or rose joint (in U.K. and elsewhere).

In some of the drawings, some of the components (such as the canopy, crown, cables, etc.) are not specifically shown and/or, but they are similar in structure to the corresponding components specifically described and/or illustrated in connection with other embodiments.

The inventive umbrella assembly provides a simple, reliable and easy to operate canopy frame assembly structure that improves structural integrity and stability of the canopy with respect to a support post, without compromising the extent and/or ease of collapsing the canopy frame.

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. An umbrella assembly, comprising:

a post;

a first pivot joint supported on the post;

a second pivot joint supported on the post at a location above the first pivot joint when the post is erected, wherein the first pivot joint and the second pivot joint are supported on the post to move relative to each other along the post;

a canopy supported by the post, comprising a collapsible frame assembly, wherein:

the frame assembly comprises a plurality of long ribs pivotally coupled to each other at one end of each long rib at a top hub, and a plurality of short ribs pivotally coupled to each other at one end of each short rib at a bottom hub, another end of each short rib is pivotally coupled to a corresponding long rib, the top hub and the bottom hub are not directly supported along the post, one of the long ribs is a support arm having an end coupled to the top hub and another end pivotally coupled to the first pivot joint on the post, and the collapsible frame assembly opens/collapses between an opened configuration and a collapsed configuration by pivoting the long ribs with respect to the short ribs with the top hub moving relative to the bottom hub; and a first strut and a second strut each having a first end and a second end, wherein:

the first end of the first strut and the first end of the second strut are pivotally coupled to the second pivot joint on the post, and the second end of the first strut is pivotally coupled to a first long rib extending at one side of the support arm and the second end of the second strut is pivotally coupled to a second long rib extending at another side of the support arm, thereby stabilizing the canopy with respect to the post.

2. The umbrella assembly as in claim 1, further comprising:

a third strut having a first end and a second end; and a fourth strut having a first end and a second end, wherein:

the first end of the third strut and the first end of the fourth strut are pivotally coupled to the first pivot joint of the post, and the second end of the third strut is pivotally coupled to the first strut and the second end of the fourth strut is pivotally coupled to the second strut, thereby further stabilizing the canopy with respect to the post.

3. The umbrella assembly as in claim 2, further comprising a support strut having a first end pivotally coupled to the second pivot joint, and a second end pivotally coupled to the support arm.

4. The umbrella assembly as in claim 3, wherein the second end of the support strut is connected to one end of a coupling bar, and the another end of a corresponding short rib pivotally coupled to the support arm is connected to another end of the coupling bar, and wherein the coupling bar is pivotally coupled to the support arm, so that the support strut and the correspond short rib pivot in unison with respect to the support arm.

5. The umbrella assembly as in claim 4, wherein the post comprises a base section and an extendible section slidably coupled to extend from and retract to the base section, wherein the base section supports the first pivot joint and the extendible section supports the second pivot joint, wherein the second pivot joint moves relative to the first pivot joint as the extendible section slides relative to the base section, and wherein the collapsible frame assembly is collapsed upon extending the extendible section to move the second pivot joint away from the base section, and the collapsible frame assembly is opened upon retracting the extendible section to move the second pivot joint towards the base section.

6. The umbrella assembly as in claim 5, wherein the base section is stationary, and the extendible section is movable to extend and retract relative to the base section, thereby respectively extending and retracting the overall length of the post.

7. The umbrella assembly as in claim 6, wherein the extendible section and the base section of the post are telescopically coupled.

8. The umbrella assembly as in claim 7, wherein the top hub and the bottom hub are telescopically coupled.

9. The umbrella assembly as in claim 8, wherein the struts and ribs are pivotally coupled by a pivotal coupling comprising at least one of (a) a spherical bearing, and (b) a fisheye bearing.

10. The umbrella assembly as in claim 3, wherein the top hub and the bottom hub are telescopically coupled.

11. The umbrella assembly as in claim 10, wherein the struts and ribs are pivotally coupled by a pivotal coupling comprising at least one of (a) a spherical bearing, and (b) a fisheye bearing.

12. An umbrella assembly, comprising:

a post;

first and second pivot joints supported on the post to move relative to each other along the post, wherein the second pivot joint is located on the post above the first pivot joint when the post is erected;

a canopy frame assembly comprising:

a plurality of long ribs, wherein one of the long ribs is a support arm having an end pivotally coupled to a common top hub and another end pivotally coupled to the first pivot joint; and a plurality of short ribs, each having an end pivotally coupled to a common bottom hub and another end pivotally coupled to a respective one of the long ribs;

a support strut having a first end pivotally coupled to the second pivot joint, and a second end pivotally coupled to the support arm;

first and second struts immediately adjacent to the support strut, each having a first end pivotally coupled to the second pivot joint and a second end pivotally coupled to a respective one of the long ribs immediately adjacent the support arm, wherein:

the top hub and the bottom hub are not directly supported along the post, the collapsible frame assembly is configurable between an opened configuration and a collapsed configuration with movement of the first and second pivot joints relative to each other.

13. The umbrella assembly as in claim 12 further comprising:

a third strut having a first end and a second end; and a fourth strut having a first end and a second end, wherein:

the first end of the third strut and the first end of the fourth strut are pivotally coupled to the first pivot joint of the post, and the second end of the third strut is pivotally coupled to the first strut and the second end of the fourth strut is pivotally coupled to the second strut, thereby further stabilizing the canopy with respect to the post.

14. The umbrella assembly as in claim 13, wherein the second end of the support strut is connected to one end of a coupling bar, and the another end of a corresponding short rib pivotally coupled to the support arm is connected to another end of the coupling bar, and wherein the coupling bar is pivotally coupled to the support arm, so that the support strut and the correspond short rib pivot in unison with respect to the support arm.

15. The umbrella assembly as in claim 14, wherein the support arm and the support strut and corresponding short rib as interconnected by the coupling bar form a scissor configuration.

16. The umbrella assembly as in claim 15, wherein the post comprises a base section and an extendible section slidably coupled to extend from and retract to the base section, wherein the base section supports the first pivot joint and the extendible section supports the second pivot joint, wherein the second pivot joint moves relative to the first pivot joint as the extendible section slides relative to the base section, and wherein the collapsible frame assembly is collapsed upon extending the extendible section to move the second pivot joint away from the base section, and the collapsible frame assembly is opened upon retracting the extendible section to move the second pivot joint towards the base section.

17. The umbrella assembly as in claim 16, wherein the extendible section and the base section of the post are telescopically coupled.

18. The umbrella assembly as in claim 17, wherein the top hub and the bottom hub are telescopically coupled.

19. The umbrella assembly as in claim 18, wherein the struts and ribs are pivotally coupled by a pivotal coupling comprising at least one of (a) a spherical bearing, and (b) a fisheye bearing.

20. The umbrella assembly as in claim 12, wherein the top hub and the bottom hub are telescopically coupled.

* * * * *